United States Patent [19]

Ellis

[11] Patent Number: 4,511,316

[45] Date of Patent: Apr. 16, 1985

[54] POSITIVE DISPLACEMENT PUMPS

[75] Inventor: Bryan E. Ellis, Eastbourne, England

[73] Assignee: SSP Pumps Limited, England

[21] Appl. No.: 394,334

[22] Filed: Jul. 1, 1982

[30] Foreign Application Priority Data

Jul. 3, 1981 [GB] United Kingdom ..... 8120637

[51] Int. Cl.[3] ..... F01C 1/18; F04C 2/00

[52] U.S. Cl. ..... 418/150; 418/206

[58] Field of Search ..... 418/150, 206

[56] References Cited

U.S. PATENT DOCUMENTS 981,862 1/1911 Keats ..... 418/206 X 3,327,637 6/1967 Hotta ..... 418/150

FOREIGN PATENT DOCUMENTS 2748665 5/1979 Fed. Rep. of Germany ..... 418/206

1411750 10/1975 United Kingdom .

2039998 8/1980 United Kingdom .

*Primary Examiner*—John J. Vrablik

*Assistant Examiner*—T. Olds

*Attorney, Agent, or Firm*—Lewis H. Eslinger

[57] ABSTRACT

A positive displacement pump comprising two lobed impellors to contra-rotate within a casing which has two ports to act respectively as an inlet and an outlet, the casing having two impellor chambers, each chamber being peripherally defined by two arcs, at least one of the arcs of each chamber being centered at a point offset from the normal rotational axis of the associated impellor in a direction towards one port.

4 Claims, 9 Drawing Figures

POSITIVE DISPLACEMENT PUMPS

This invention relates to positive displacement pumps, and more particularly to positive displacement lobe pumps of the type comprising a pair of lobed contra-rotating impellors housed in a robust casing and having two or more equispaced lobes per impellor. The impellors are on shafts extending at both, or more commonly one end into bearings in the casing. Such pumps are widely used in the chemical, pharmaceutical and food industries where it is found that three lobes per impellor is suitable for most general applications.

FIG. 1 of the accompanying drawings at (a) to (e) shows stages in the pumping action of a pump of this type. The upper impellor rotates clockwise, the lower one anticlockwise as shown but like-most pumps of this type this is reversible. The inlet is on the left and the outlet on the right.

The shape of the impellors is such that when meshing occurs a small but regular gap exists between them to minimise the small flow that slips between them. Similarly the outer faces of the impellors are close to the housing walls to minimise leakage by this route. The housing walls are usually of arcuate form with centres on or near to the shaft centres, and the arrangement is symmetrical to allow reversibility which may be a requirement apart from being a convenience.

In use of such pumps, the liquid pressure on the outlet side is normally greater than that of the inlet side, the value of the differential pressure being dependent on the particular application to which the pump is being put. This differential pressure tends to push both impellors towards the inlet port with a force dependent on the pressure and the area offered by the impellors. This force is resisted by the shafts on which the impellors are mounted and therefore the shafts bend as a result of the elastic nature of metals, to a greater extent, of course, in the more common case where the shafts have only one bearing.

This movement is usually allowed for by having the effective swept diameter of the rotor smaller than the housing internal diameter for each impellor. However, this results in loss of efficiency due to the high clearance values needed to achieve a high pressure rating for the particular unit. Further, the differential pressure tends to force the liquid through all leakage paths back to the inlet port and it is thus clear that higher pressure ratings, and increased clearances, are only obtained at the expense of volumetric efficiency, which is the measure of quantities pumped in practice in relation to theoretical pumping.

The impellor movement which occurs under pressure conditions involves movement towards the inlet side and also movement of the impellors towards one another. This effect can be observed by taking a pump to a pressure slightly above its normal rating and observing where the impellor impinges on the housing wall, and side wall. In FIG. 2 of the accompanying drawings, which is schematic, area A is where interference between impellors and casing occurs.

According to the present invention there is provided a rotary lobe positive displacement pump comprising two externally driven lobed impellors to contra-rotate within a casing without, in normal use, mutual contact or contact with the casing, the casing having two ports to act respectively as an inlet and an outlet, the casing having two impellor chambers, each chamber being peripherally defined by two arcs, one of the arcs of each chamber being centered at a point offset from the nominal rotational axis of the associated impellor in a direction towards a port.

Preferably, the arcs of each chamber are both centered at points offset from the nominal rotational axis of the associated impellor in respective directions towards the adjacent ports.

Preferably the, or as the case may be each, arc which has such an offset centre has a smaller radius than that which is normally used in the prior art.

With the invention, allowance is made for shaft deflections in the direction in which these occur in high pressure running and as a result the leakage occurring is reduced so that volumetric efficiency is not sacrificed when high pressures are used, because the additional clearance is only provided where it is necessary.

In order that the invention may be more clearly understood, the following description is given by way of example only with reference to the further accompanying drawings in which.

Figure 3:
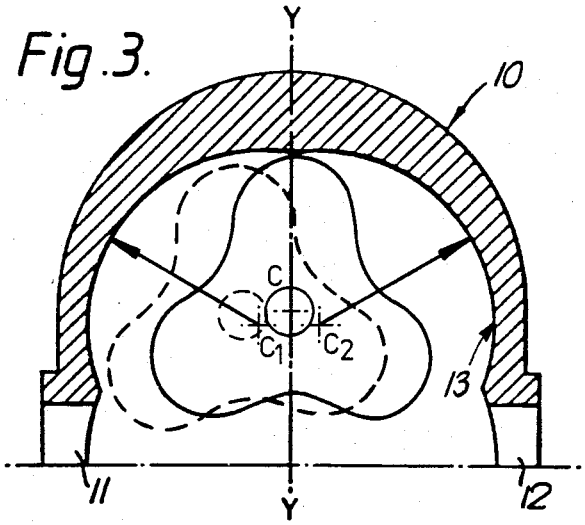
FIG. 3 is a partial cross section of a pump according to this invention.

FIG. 3, shows in cross section the upper half of a casing 10 with reversable inlet and outlet ports 11 and 12 and an upper rotor. At C is the shaft centre in no-load conditions, which in prior pumps has also been the centre of the periphery of the impellor chamber here shown at 13. However, according to the invention this periphery is in two arcuate parts, centred at $C_1$ and $C_2$. It can be seen that the centres $C_1$ and $C_2$ are equispaced about centreline Y to give two way reversible running of the pump. These centres are also closer to the centreline running through the centres of the inlet and outlet ports. The radius of the housing bores is generally similar to that employed by the usual concentric method of construction.

At maximum load, the rotor, as shown in dotted lines, has its center displaced towards the inlet so that its clearance with the inlet end of the housing, which here is shown very much exaggerated for clarity, is at a predetermined minimum, thus providing most effective resistance to leakage in this area.

Figure 1A:
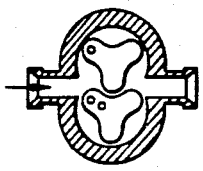
Fig. 1(a) PRIOR ART
FIGS. 1 and 2 illustrate conventional pump structure.
Figure 1B:
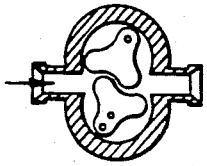
Fig. 1(b) PRIOR ART
Figure 1C:
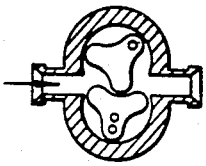
Fig. 1(c) PRIOR ART
Figure 1D:
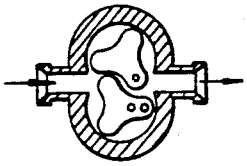
Fig. 1(d) PRIOR ART
Figure 1E:
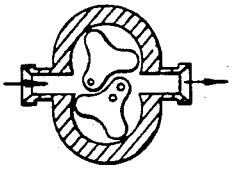
Fig. 1(e) PRIOR ART
Figure 4:
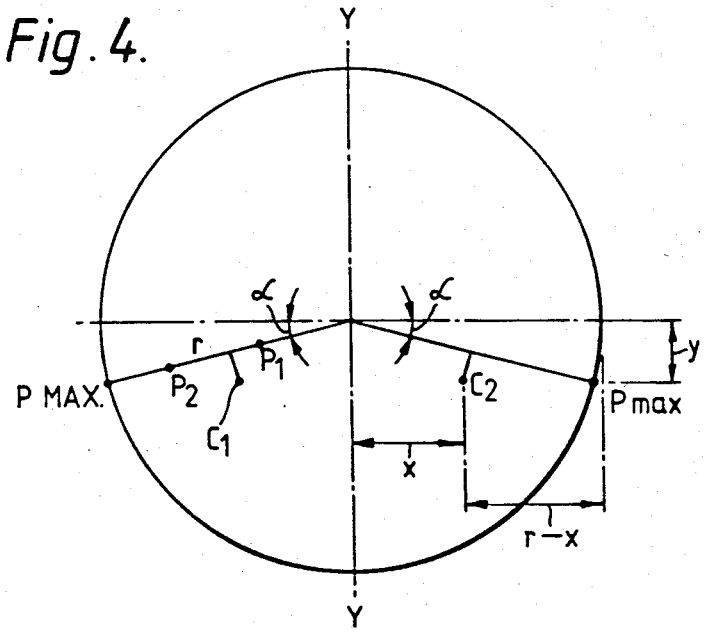
FIG. 4 is to assist understanding of the location of the centres of the arcs of the chambers of the casing.
Figure 2:
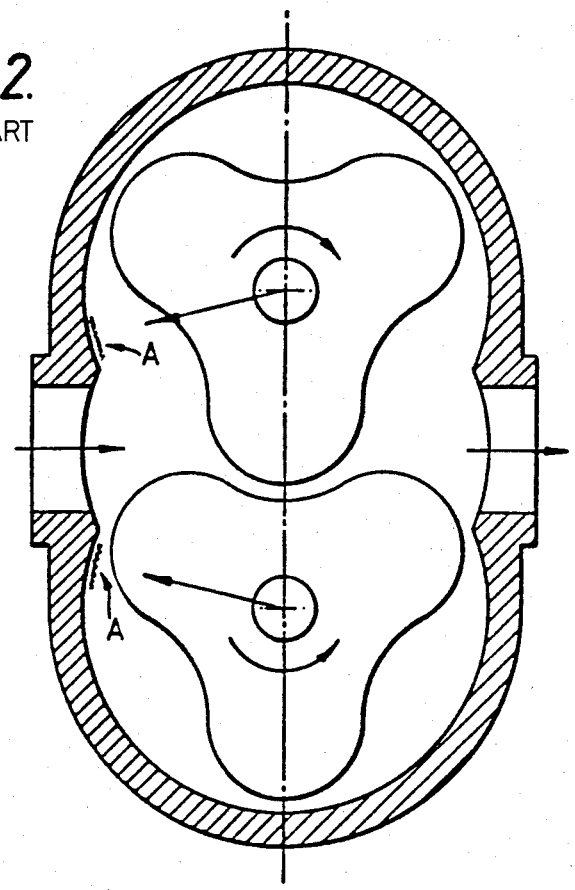
Fig. 2. PRIOR ART

The exact preferred positions of the centres from the impellor centre, and of the radius of the arcuate walls is explained with the aid of FIG. 4, which shows on an enlarged scale the region of the shaft and casing centre.

The nominal shaft centre is at C. Under the influence of differential pressure this moves depending on the direction of pumping along one of the lines inclined at angle $\alpha$ to the perpendicular to the line joining nominal shaft centres. The extent of movement depends on the proportion of allowed working differential pressure. The maximum deflection, r, corresponds to working pressure P max. Due to the linear relationship between force and deflection there is a linear relationship between differential pressure and deflection. Angle $\alpha$ is typically 15°. When the rotor is at nominal centre, the maximum clearance therefore is r along the lines referred to, and r is the maximum allowable movement for the shaft centre.

A satisfactory method of determining the new radius centres for the housing arcs is to draw the perpendicular bi-sectors of the lines C-P. max and take as centres the points where these lines cross the horizontal line drawn through P. max. These points are shown at $C_1$, and $C_2$ on FIG. 4.

An x and y shift from centre C is also shown, and can be marked out as follows.

To allow for at least the rotor displacement of r corresponding to P. max pressure to be accommodated along the lines C-P. max described above for a given rotor radius R, the rotorcase radius is given by R+r−x where x is the offset in the horizontal direction of the centres $C_1$ and $C_2$ from which the arcs are drawn. Thus, x is given by $$r\text{Cos}\,\alpha - \frac{r}{2\,\text{Cos}\,\alpha} = r\left(\text{Cos}\,\alpha - \frac{1}{2\,\text{Cos}\,\alpha}\right)$$

y is given by r tan $\alpha$.

The new cutting radius is given by $$R + r - x = R + r - r\left(\text{Cos}\,\alpha - \frac{1}{2\,\text{Cos}\,\alpha}\right) =$$

$$R + r\left(1 - \text{Cos}\,\alpha + \frac{1}{2\,\text{Cos}\,\alpha}\right)$$

It has been found that by constructing rotary lobe impellor pumps in this way an increase in volumetric efficiency can be brought about. This invention has been demonstrated to be effective with reference to a standard stainless steel positive displacement pump manufactured by SSP Pumps Ltd. known by the code Number AP 400, of which the maximum outlet operating pressure is 100 psi.

Figure 5:
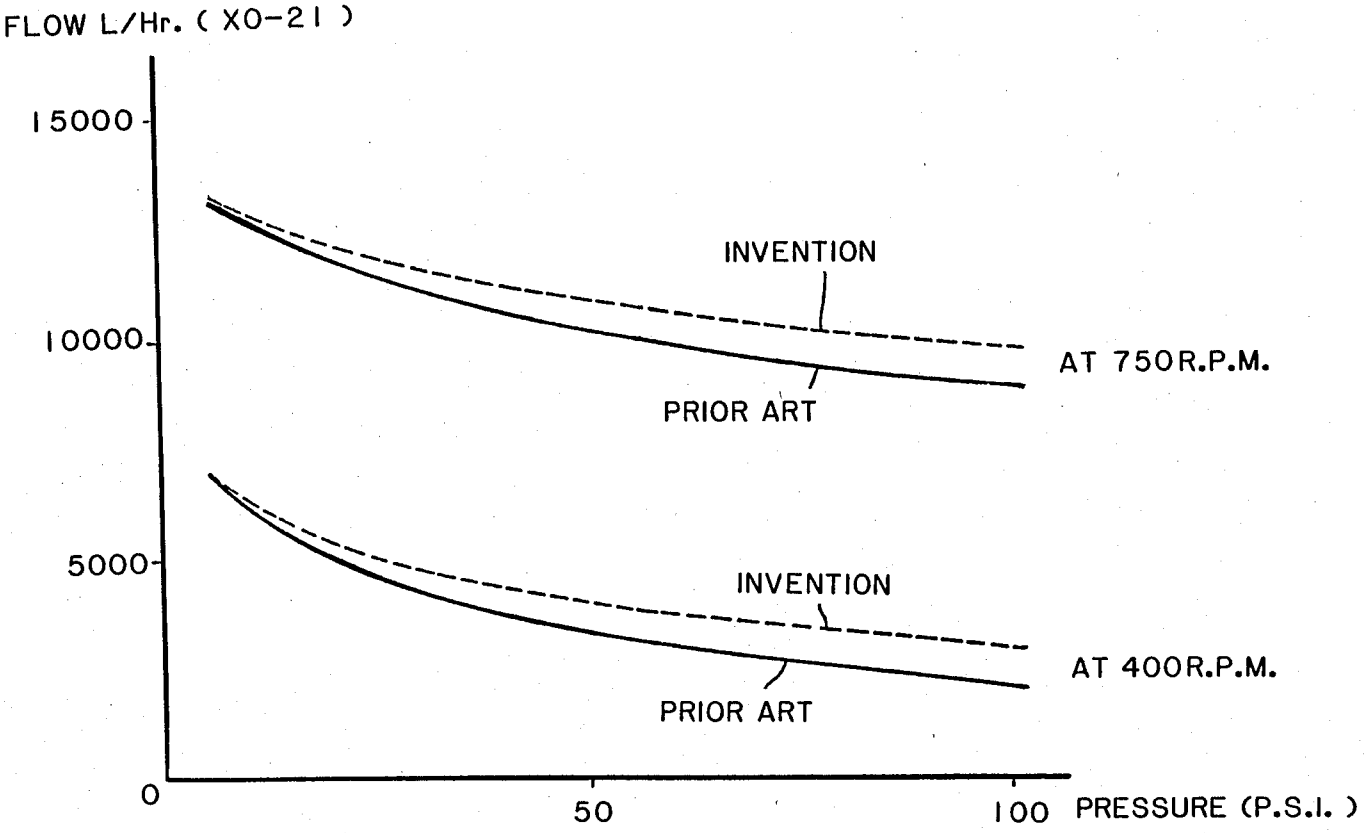
FIG. 5 illustrates relative pumping performance of a pump according to the invention and an equivalent prior art pump.

A standard pump was tested to obtain the performance characteristic curve. Flow plotted against differential pressure is usually plotted for a given rotational speed, and this is shown in FIG. 5 for speeds of 750 and 400 RPM. A pump housing was then manufactured using the methods described in this invention. This was then fitted to the tested pump in place of the standard rotor case and the unit subjected to the same test, using the same impellors. Equivalent curves were obtained, showing up to 10% increased flow, i.e. notably higher volumetric efficiency.

I claim:

1. A rotary lobe positive displacement pump comprising two externally driven lobed impellers to contra-rotate within a casing without, in normal use, mutual contact or contact with the casing, the casing having two ports to act respectively as an inlet and an outlet, said ports being positioned on an axis extending intermediate said impellers and being perpendicular to a line joining the rotational axis of the impellers, the casing having two impeller chambers, each chamber being peripherally defined by two arcs, one of the arcs of each chamber being centered at a point offset from the nominal rotational axis of the associated impeller, the offset of said point from said rotational axis being in a direction having one component parallel to the line joining the axes of the impellers and extending towards the other impeller and another component parallel to the center lines of the ports and extending towards one of said ports.

2. A pump according to claim 1, wherein the arcs of each chamber are both centered at points offset from the nominal rotational axis of the associated impeller in respective directions towards the adjacent ports.

3. A pump according to claim 2, wherein the arcs are centered equal distances from the line connecting the nominal rotational centres of the impellers.

4. A pump according to claim 1, wherein each offset centre is offset by x and y from the corresponding impeller nominal rotational centre where the x and y offsets are respectively perpendicular and parallel to the line joining the nominal rotational centres and are approximately given by $$x = r\left(\text{Cos}\,\alpha - \frac{1}{2\,\text{Cos}\,\alpha}\right)$$

and y=r tan $\alpha$ where r is the maximum clearance at zero pressure between rotor tip and peripheral wall (i.e. maximum rotor deflection at rated P. max) and $\alpha$ is the acute angle between the pumping direction and the direction of movement of the actual impeller rotational centre when the pump is operating under pressure.

* * * * *